US011549665B2

(12) United States Patent
Liang et al.

(10) Patent No.: US 11,549,665 B2
(45) Date of Patent: Jan. 10, 2023

(54) MULTIFUNCTION LIGHTING APPARATUS

(71) Applicant: XIAMEN ECO LIGHTING CO. LTD., Xiamen (CN)

(72) Inventors: Jinhui Liang, Xiamen (CN); Yongzhe Dong, Xiamen (CN); Xiaoliang Wen, Xiamen (CN); Shouqiang Hou, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/801,098

(22) Filed: Feb. 25, 2020

(65) Prior Publication Data

US 2020/0271304 A1 Aug. 27, 2020

(30) Foreign Application Priority Data

Feb. 26, 2019 (CN) ..... 201920244727.2

(51) Int. Cl.

| | |
|---|---|
| ***F21V 17/02*** | (2006.01) |
| ***F21V 17/00*** | (2006.01) |
| ***F21V 7/04*** | (2006.01) |
| ***F21V 5/04*** | (2006.01) |
| ***F21V 15/01*** | (2006.01) |
| ***F21S 8/02*** | (2006.01) |
| ***F21V 13/04*** | (2006.01) |
| ***F21V 23/04*** | (2006.01) |
| ***F21V 23/00*** | (2015.01) |
| ***F21V 29/70*** | (2015.01) |
| *F21Y 115/10* | (2016.01) |

(52) U.S. Cl.

CPC ..... *F21V 17/02* (2013.01); *F21S 8/02* (2013.01); *F21V 5/04* (2013.01); *F21V 7/04* (2013.01); *F21V 13/04* (2013.01); *F21V 15/01* (2013.01); *F21V 17/002* (2013.01); *F21V 23/007* (2013.01); *F21V 23/04* (2013.01); *F21V 29/70* (2015.01); *F21Y 2115/10* (2016.08)

(58) Field of Classification Search

CPC ..... F21V 17/02; F21V 17/002; F21V 29/70; F21V 5/04; F21V 15/01; F21V 23/007; F21V 23/04; F21S 8/02

See application file for complete search history.

(56) References Cited

U.S. PATENT DOCUMENTS

| | | | | |
|---|---|---|---|---|
| 3,518,420 A * | 6/1970 | Kripp | F21S 8/02 | 362/257 |
| 5,295,056 A * | 3/1994 | Peck | F21V 17/02 | 362/267 |
| 5,562,343 A * | 10/1996 | Chan | F21S 8/02 | 362/147 |
| 6,283,430 B1 * | 9/2001 | Schubert | F21S 8/02 | 248/314 |
| 6,343,873 B1 * | 2/2002 | Eberhard | F21V 19/00 | 362/147 |

(Continued)

*Primary Examiner* — Anabel Ton

(74) *Attorney, Agent, or Firm* — Chun-Ming Shih; Lanway IPR Services

(57) ABSTRACT

A multifunction lighting apparatus includes a light body, an adjustment bracket, and a frame. More than one optical unit may be selected to be installed to the multifunction lighting apparatus. In addition, the light body may be moved with respect to the adjustment bracket to provide more flexible light effect.

8 Claims, 7 Drawing Sheets

(56) References Cited

U.S. PATENT DOCUMENTS

| | | | | |
|---|---|---|---|---|
| 6,431,723 | B1 * | 8/2002 | Schubert | F21S 8/02 362/147 |
| 6,474,837 | B1 * | 11/2002 | Belliveau | F21L 4/027 362/231 |
| 6,832,845 | B1 * | 12/2004 | Kretzschmar | E04B 9/32 362/268 |
| 7,364,323 | B2 * | 4/2008 | Francois | F21V 21/04 248/200 |
| 9,541,268 | B2 * | 1/2017 | Clark | F21V 23/026 |
| 9,803,838 | B1 * | 10/2017 | Wronski | F21S 8/02 |
| 2010/0246194 | A1 * | 9/2010 | Nankil | F21S 8/033 362/368 |
| 2011/0013405 | A1 * | 1/2011 | Buse | F21V 21/04 362/365 |
| 2015/0276141 | A1 * | 10/2015 | White | F21S 8/026 362/147 |
| 2015/0300612 | A1 * | 10/2015 | Stathes | F21S 8/026 362/419 |
| 2019/0195475 | A1 * | 6/2019 | Jones | F21V 21/048 |

* cited by examiner

MULTIFUNCTION LIGHTING APPARATUS

FIELD

The present invention is related to a LED lighting apparatus and more particularly related to a LED lighting apparatus with multiple functions.

BACKGROUND

Lighting or illumination is the deliberate use of light to achieve a practical or aesthetic effect. Lighting includes the use of both artificial light sources like lamps and light fixtures, as well as natural illumination by capturing daylight. Daylighting (using windows, skylights, or light shelves) is sometimes used as the main source of light during daytime in buildings. This can save energy in place of using artificial lighting, which represents a major component of energy consumption in buildings. Proper lighting can enhance task performance, improve the appearance of an area, or have positive psychological effects on occupants.

Indoor lighting is usually accomplished using light fixtures, and is a key part of interior design. Lighting can also be an intrinsic component of landscape projects.

A light-emitting diode (LED) is a semiconductor light source that emits light when current flows through it. Electrons in the semiconductor recombine with electron holes, releasing energy in the form of photons. This effect is called electroluminescence. The color of the light (corresponding to the energy of the photons) is determined by the energy required for electrons to cross the band gap of the semiconductor. White light is obtained by using multiple semiconductors or a layer of light-emitting phosphor on the semiconductor device.

Appearing as practical electronic components in 1962, the earliest LEDs emitted low-intensity infrared light. Infrared LEDs are used in remote-control circuits, such as those used with a wide variety of consumer electronics. The first visible-light LEDs were of low intensity and limited to red. Modern LEDs are available across the visible, ultraviolet, and infrared wavelengths, with high light output.

Early LEDs were often used as indicator lamps, replacing small incandescent bulbs, and in seven-segment displays. Recent developments have produced white-light LEDs suitable for room lighting. LEDs have led to new displays and sensors, while their high switching rates are useful in advanced communications technology.

LEDs have many advantages over incandescent light sources, including lower energy consumption, longer lifetime, improved physical robustness, smaller size, and faster switching. Light-emitting diodes are used in applications as diverse as aviation lighting, automotive headlamps, advertising, general lighting, traffic signals, camera flashes, lighted wallpaper and medical devices.

Unlike a laser, the color of light emitted from an LED is neither coherent nor monochromatic, but the spectrum is narrow with respect to human vision, and functionally monochromatic.

The energy efficiency of electric lighting has increased radically since the first demonstration of arc lamps and the incandescent light bulb of the 19th century. Modern electric light sources come in a profusion of types and sizes adapted to many applications. Most modern electric lighting is powered by centrally generated electric power, but lighting may also be powered by mobile or standby electric generators or battery systems. Battery-powered light is often reserved for when and where stationary lights fail, often in the form of flashlights, electric lanterns, and in vehicles.

Although lighting devices are widely used, there are still lots of opportunity and benefit to improve the lighting devices to provide more convenient, low cost, reliable and beautiful lighting devices for enhancing human life.

SUMMARY

In an embodiment, a multifunction lighting apparatus includes a light body, an adjustment bracket and a frame. The light body emits a light. The light body is fixed to the adjustment bracket and is movable with respect to the adjustment bracket. The frame supports and fixes the adjustment bracket.

In addition, more than one optical unit may be installed to the multifunction lighting apparatus. For example, a first optical unit or a second optical unit may be installed to the multifunction lighting apparatus for meeting different needs. Specifically, the first optical unit may be a downlight reflector and the second optical unit may be a wall grazer reflector. The downlight reflector mainly guides the light of the light body to a central direction the same as a main direction of the light of the light body. On the other hand, when the downlight reflector is detached from the multifunction lighting apparatus and the wall grazer reflector is installed, the light of the light body is guided to a wall surface to be light washed by the light body.

In other words, by replacing the first optical unit, the second optical unit or other optical unit, the same light body may be used to generate different light patterns for different needs. Such optical units may be detachable and replaceable from the multifunction lighting apparatus for adjusting different functions of the multifunction lighting apparatus.

Such optical units may contain more than one optical component. For example, a lends for condensing light, a diffusion cover for diffusing light, a light guide for guiding the light to an output surface, a reflector, or other optical parts may be independently used or combined to form necessary light patterns.

In some embodiments, there is a rotation structure for connecting the adjustment bracket and the light body so that the light body is rotatable with respect to the adjustment bracket for changing an output direction of the light. The rotation structure may include two parts. A first part is disposed on the light body, and the second part is disposed on the adjustment bracket. To make the light body to manually rotatable with respect to the adjustment bracket, a pivot with a rotation hole may be used forming the rotation structure. Other structures may be used. In addition, the adjustment bracket may have some stopping structure for preventing a rotation angle larger than a maximum rotation angle.

With the rotation, the light output of the light body may be tilted for a desired tilt angle. For example, to use the multifunction lighting apparatus as a wall grazer light, the light body may be tilted with a desired tilt angle to render a desired light effect on a wall surface.

In some embodiments, there is a shift structure for connecting the adjustment bracket and the light body so that the light body is shifted with respect to the adjustment bracket for changing a relative distance of the light to the frame. In other words, in addition to adjust a relative rotation angle between the light body, a relative distance between the light body and the adjustment bracket may be adjusted. When the adjustment bracket is fixed on the frame, the relative distance between the light body and the frame may be adjusted.

When there is a lens disposed on the frame, the distance change may adjust a light pattern when the light of the light body passes through the lens.

For example, in some embodiments, when the light body is shifted with respect to the adjustment bracket, a beam angle of an output light is changed accordingly, when the lens is used for condensing a light. The distance between a light source to the lens changes a light beam angle, e.g. to become wider or narrower by adjusting the relative distance.

In some embodiments, the frame is selectively to dispose a first pair of elastic structure and a second pair of elastic structure respectively corresponding to a standard US installation base and to a standard European installation base.

As known to persons in the art, the world has areas adopting different standards for installing a downlight to an installation cavity or an installation box, as an installation base mentioned above, on a ceiling. In American, there may be two elastic springs as the first pair of elastic structure of a standard U.S. installation base. In Europe, there may be two elastic plate expandable and shrinkable for fitting the multifunction lighting apparatus in an installation base. The elastic springs and the elastic plates are different and they may be arranged evenly in the frame, e.g. 90 degrees for two adjacent elastic structure, while the same pair of elastic structures are disposed opposite to each other.

In some embodiments, the first pair of elastic structure are disposed opposite to each other, two adjacent elastic structures of the first pair of elastic structure and the second pair of elastic structure are spaced with substantially 90 degrees.

In some embodiments, the frame is selectively to dispose a third pair of fixing structure for a frameless installation base. In addition to the frame base, the frame may provide a connector structure, e.g. two holes, for fitting another pair of fixing structures. Such fixing structures may be a L shaped plate with a first side fixing to the frame while another side fixing to a frameless installation base.

In some embodiments, the first optical unit may include a downlight reflector, and the second optical unit comprises a wall grazer reflector.

In some embodiments, the second optical unit may further include a polarizing lens.

In some embodiments, the polarizing lens has a plurality of teardrop shape lens. Such teardrop shape lens are arranged on a lens surface for guiding a tilt light to spread evenly over a projected wall surface. The teardrop shape lens are found helpful for providing a smooth gapless light effect, thus great for wall washer effect.

In some embodiments, the first optical unit is detachably fixed to the adjustment bracket with a detachable connector, and the second optical unit is detachably fixed to the adjustment bracket with the detachable connector. For example, the detachable connector may include an elastic clip and a corresponding groove so that when a portion of the elastic chip engages the corresponding groove, the elastic clip is kept and fixed to the corresponding groove for fixing the optical unit to the multifunction lighting apparatus.

In some embodiments, the frame is arranged between the adjustment bracket and the first optical unit. In such case, the optical unit is attached to the adjustment bracket.

In some embodiments, the first optical unit is detachably fixed to the light body with a detachable connector, and the second optical unit is also detachably fixed to the light body with the detachable connector.

In some embodiments, the light body has a metal housing, a light source and a light body lens.

In some embodiments, the metal housing carries heat of the light source away from the light source.

In some embodiments, the light body includes a first body and a second part. A relative distance between the first body and the second part is adjustable for changing a relative position of the light source to the light body lens for outputting different light patterns.

In some embodiments, the light body has a manual switch for selecting one from multiple modes of the light source. For example, the manual switch may be rendered as a control message to a driver to activate a set of LED chips, to deactivate another set of LED chips, or mixing lights of two sets of different LED chips for rendering a necessary light pattern or light characteristics.

In some embodiments, the multifunction lighting apparatus may further include a driver box containing a driver for converting an indoor power to a driving current to the light source, wherein the driver box is made of metal material.

In some embodiments, the driver box is kept with no direct contact with a metal housing of the light body. In such design, the heat of the driver box is not affecting the light source in the light body.

In some other embodiments, the driver box contacts a metal housing of the light body for helping heat dissipation of the light source. This is helpful particularly when the driver box is made of fire-proof material like metal material. Such arrangement further enhances the heat dissipation of the light body, which is a critical issue while designing a commercial lighting apparatus because larger power is supplied to the light source of the light body.

DETAILED DESCRIPTION

Figure 9:
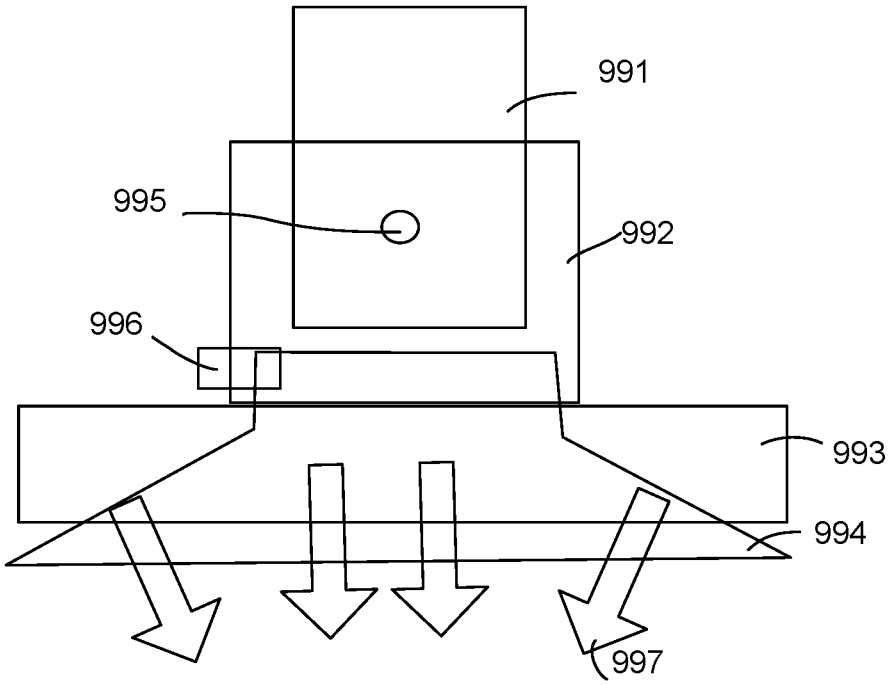
FIG. 9 illustrates a first status of a multifunction lighting apparatus.
Figure 10:
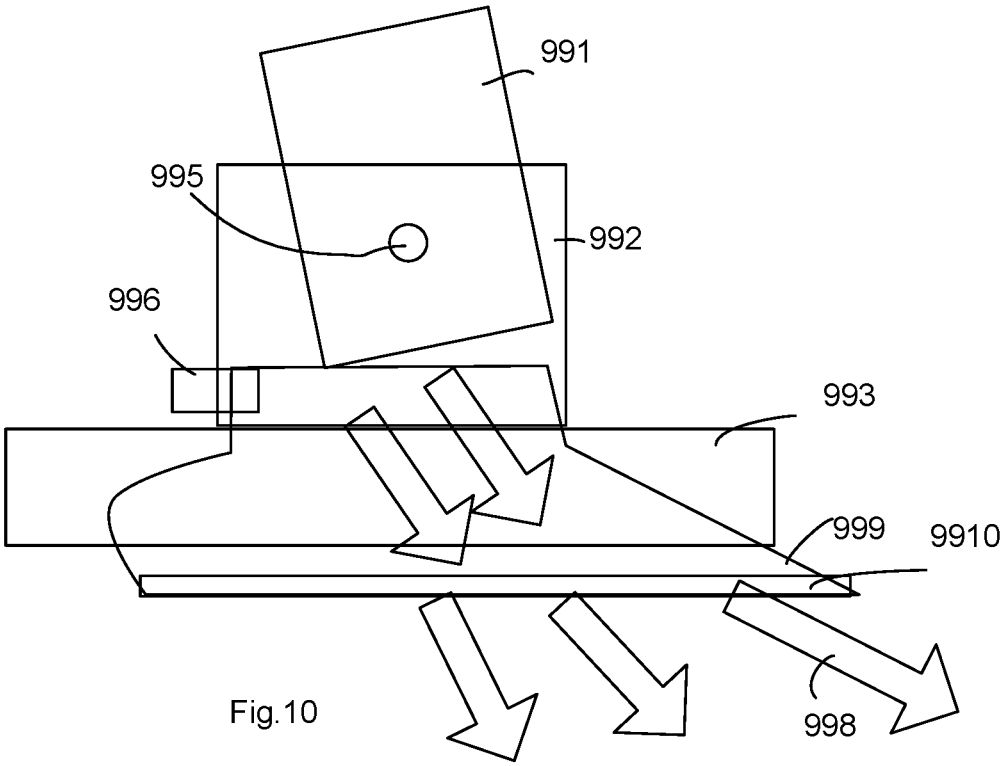
FIG. 10 illustrates a second status of the multifunction lighting apparatus of FIG. 9.

Please refer to FIG. 9 and FIG. 10. In FIG. 9, a multifunction lighting apparatus includes a light body 991, an adjustment bracket 992 and a frame 993. The light body 991 emits a light. The light body 991 is fixed to the adjustment bracket 992 and is movable with respect to the adjustment bracket 992. The frame 993 supports and fixes the adjustment bracket 992.

In addition, more than one optical unit may be installed to the multifunction lighting apparatus. For example, a first optical unit 993 in FIG. 9 or a second optical unit 999 in FIG. 10 may be installed to the multifunction lighting apparatus for meeting different needs.

The light body 991 may be moved with respect to the adjustment bracket 992. For example, a rotation structure 995 is placed for connecting the light body 991 and the adjustment bracket 992 so that the light body 991 is rotatable with respect to the adjustment bracket 992.

The first optical unit 994 is attached to the adjustment bracket via a connector 996. The connector 996 provides a detachable mechanism so that users may replace the first optical unit 994 in FIG. 9 to the second optical unit 999 in FIG. 10.

In FIG. 9, the light of the light body 991 is guided by the first optical unit 994 to desired directions 997 to form a desired light pattern.

Please refer to FIG. 10. In FIG. 10, the same reference numerals as FIG. 9 refer to the same components. In FIG. 10, the light body 991 is rotated with a tilt angle with respect to the adjustment bracket 992. In addition, a polarizing lens 9910 may be placed to the second optical unit 999 to further guide the output light to desired directions 998, e.g. to provide a better wall washing effect.

Specifically, the first optical unit may be a downlight reflector and the second optical unit may be a wall grazer reflector. The downlight reflector mainly guides the light of the light body to a central direction the same as a main direction of the light of the light body. On the other hand, when the downlight reflector is detached from the multifunction lighting apparatus and the wall grazer reflector is installed, the light of the light body is guided to a wall surface to be light washed by the light body.

In other words, by replacing the first optical unit, the second optical unit or other optical unit, the same light body may be used to generate different light patterns for different needs. Such optical units may be detachable and replaceable from the multifunction lighting apparatus for adjusting different functions of the multifunction lighting apparatus.

Such optical units may contain more than one optical component. For example, a lends for condensing light, a diffusion cover for diffusing light, a light guide for guiding the light to an output surface, a reflector, or other optical parts may be independently used or combined to form necessary light patterns.

In some embodiments, there is a rotation structure for connecting the adjustment bracket and the light body so that the light body is rotatable with respect to the adjustment bracket for changing an output direction of the light. The rotation structure may include two parts. A first part is disposed on the light body, and the second part is disposed on the adjustment bracket. To make the light body to manually rotatable with respect to the adjustment bracket, a pivot with a rotation hole may be used forming the rotation structure. Other structures may be used. In addition, the adjustment bracket may have some stopping structure for preventing a rotation angle larger than a maximum rotation angle.

With the rotation, the light output of the light body may be tilted for a desired tilt angle. For example, to use the multifunction lighting apparatus as a wall grazer light, the light body may be tilted with a desired tilt angle to render a desired light effect on a wall surface.

In some embodiments, there is a shift structure for connecting the adjustment bracket and the light body so that the light body is shifted with respect to the adjustment bracket for changing a relative distance of the light to the frame. In other words, in addition to adjust a relative rotation angle between the light body, a relative distance between the light body and the adjustment bracket may be adjusted. When the adjustment bracket is fixed on the frame, the relative distance between the light body and the frame may be adjusted. When there is a lens disposed on the frame, the distance change may adjust a light pattern when the light of the light body passes through the lens.

For example, in some embodiments, when the light body is shifted with respect to the adjustment bracket, a beam angle of an output light is changed accordingly, when the lens is used for condensing a light. The distance between a light source to the lens changes a light beam angle, e.g. to become wider or narrower by adjusting the relative distance.

In some embodiments, the frame is selectively to dispose a first pair of elastic structure and a second pair of elastic structure respectively corresponding to a standard US installation base and to a standard European installation base.

As known to persons in the art, the world has areas adopting different standards for installing a downlight to an installation cavity or an installation box, as an installation base mentioned above, on a ceiling. In American, there may be two elastic springs as the first pair of elastic structure of a standard U.S. installation base. In Europe, there may be two elastic plate expandable and shrinkable for fitting the multifunction lighting apparatus in an installation base. The elastic springs and the elastic plates are different and they may be arranged evenly in the frame, e.g. 90 degrees for two adjacent elastic structure, while the same pair of elastic structures are disposed opposite to each other.

In some embodiments, the first pair of elastic structure are disposed opposite to each other, two adjacent elastic structures of the first pair of elastic structure and the second pair of elastic structure are spaced with substantially 90 degrees.

In some embodiments, the frame is selectively to dispose a third pair of fixing structure for a frameless installation base. In addition to the frame base, the frame may provide a connector structure, e.g. two holes, for fitting another pair of fixing structures. Such fixing structures may be a L shaped plate with a first side fixing to the frame while another side fixing to a frameless installation base.

In some embodiments, the first optical unit may include a downlight reflector, and the second optical unit comprises a wall grazer reflector.

In some embodiments, the second optical unit may further include a polarizing lens.

In some embodiments, the polarizing lens has a plurality of teardrop shape lens. Such teardrop shape lens are arranged on a lens surface for guiding a tilt light to spread evenly over a projected wall surface. The teardrop shape lens are found helpful for providing a smooth gapless light effect, thus great for wall washer effect.

In some embodiments, the first optical unit is detachably fixed to the adjustment bracket with a detachable connector, and the second optical unit is detachably fixed to the adjustment bracket with the detachable connector. For example, the detachable connector may include an elastic clip and a corresponding groove so that when a portion of the elastic chip engages the corresponding groove, the elastic clip is kept and fixed to the corresponding groove for fixing the optical unit to the multifunction lighting apparatus.

In some embodiments, the frame is arranged between the adjustment bracket and the first optical unit. In such case, the optical unit is attached to the adjustment bracket.

In some embodiments, the first optical unit is detachably fixed to the light body with a detachable connector, and the second optical unit is also detachably fixed to the light body with the detachable connector.

In some embodiments, the light body has a metal housing, a light source and a light body lens.

In some embodiments, the metal housing carries heat of the light source away from the light source.

In some embodiments, the light body includes a first body and a second part. A relative distance between the first body and the second part is adjustable for changing a relative position of the light source to the light body lens for outputting different light patterns.

In some embodiments, the light body has a manual switch for selecting one from multiple modes of the light source. For example, the manual switch may be rendered as a control message to a driver to activate a set of LED chips, to deactivate another set of LED chips, or mixing lights of two sets of different LED chips for rendering a necessary light pattern or light characteristics.

In some embodiments, the multifunction lighting apparatus may further include a driver box containing a driver for converting an indoor power to a driving current to the light source, wherein the driver box is made of metal material.

In some embodiments, the driver box is kept with no direct contact with a metal housing of the light body. In such design, the heat of the driver box is not affecting the light source in the light body.

In some other embodiments, the driver box contacts a metal housing of the light body for helping heat dissipation of the light source. This is helpful particularly when the driver box is made of fire-proof material like metal material. Such arrangement further enhances the heat dissipation of the light body, which is a critical issue while designing a commercial lighting apparatus because larger power is supplied to the light source of the light body.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

Please refer to FIG. 1 to FIG. 8 for the following description for the embodiment of a multifunction lighting apparatus. The embodiment provides the multifunction lighting apparatus, including the light body. The light body includes downlight 1 and light source module 2 that is disposed within downlight 1. The multifunction lighting apparatus also includes two kinds of reflection cup body for downlight and wall grazer, and a adjustment bracket 3 for changing a reflection cup body of the light body. An end of the downlight is an opened end. The other end is a closed end. The adjustment bracket 3 is fixed on a bottom end of the downlight 1 and surrounding downlight 1. Each of the reflection cup body has an opening to insert into an upper end of the downlight 1. An inner side wall of the ring shaped bracket 3 is equipped with connection groove 31. The two reflection cup bodies are built with clip unit 4 in order to install each of the reflection cup body to the light body and to correspond to connection groove 31. The two reflection cup body is a downlight reflective optic 5 and a wall grazer light reflective optic 6.

In an embodiment, the two reflection cup bodies are the downlight reflective optic 5 and the wall grazer light reflective optic 6. The two reflection cup bodies are built with the clip unit 4 in order to install each reflection cup body to the light body and to correspond to connection groove 31. When using the lighting apparatus as downlight, the wall grazer light mode lighting apparatus does not need to be entirely detached. Simply detach the wall grazer light reflection cup body, and replace it with downlight reflection cup body. Similarly, when using the lighting apparatus as wall grazer light, the downlight mode lighting apparatus does not need to be entirely detached. Simply detach the downlight reflection cup body 5, and replace it with wall grazer light reflection cup body 6. Therefore, the multifunction illuminating lighting apparatus has both the downlight function and the wall grazer light function. Thus, meeting business lighting apparatus is needed for downlight and wall grazer light, enhancing a versatility of the business lighting apparatus, reduce manufacturing and user cost, and overcome a single lighting mode of the business lighting apparatus. The single lighting mode of the business lighting apparatus usually results in either using the downlight or the wall grazer light, which does not meet multifunction demands.

In an embodiment, compared with currently existing technology, contains two kinds of the multifunction lighting apparatus with the reflection cup body used for replacing light body. Adjustment bracket 3 is disposed on downlight 1 which is equipped with the light source module 2. The reflection cup body is buckled onto adjustment bracket 3 and is detachable. This makes it easier for users to switch between downlight and wall grazer light. Simply install downlight (downlight reflective optic 5) or the reflection cup body of the wall grazer light (wall grazer light reflective optic 6) to achieve multifunction illumination mode for both downlight and wall grazer light. The business lighting apparatus may now use both the downlight and the wall grazer light, overcoming single illumination modes, and enhance the versatility.

Preferably, light source module 2 includes an illuminating source light source 21, a light source fixing bracket 22 that the light source 21 is installed on, lens 23 that enhances the illumination effects, and lens fixing ring 24 that the lens 23 is installed on. Among them, light source 21 uses two or more color temperature chips. Chips may be packed using COB or SMD. It may switch between different color temperatures. The switch on the driver adjusts the different color temperature illuminations.

Figure 2:
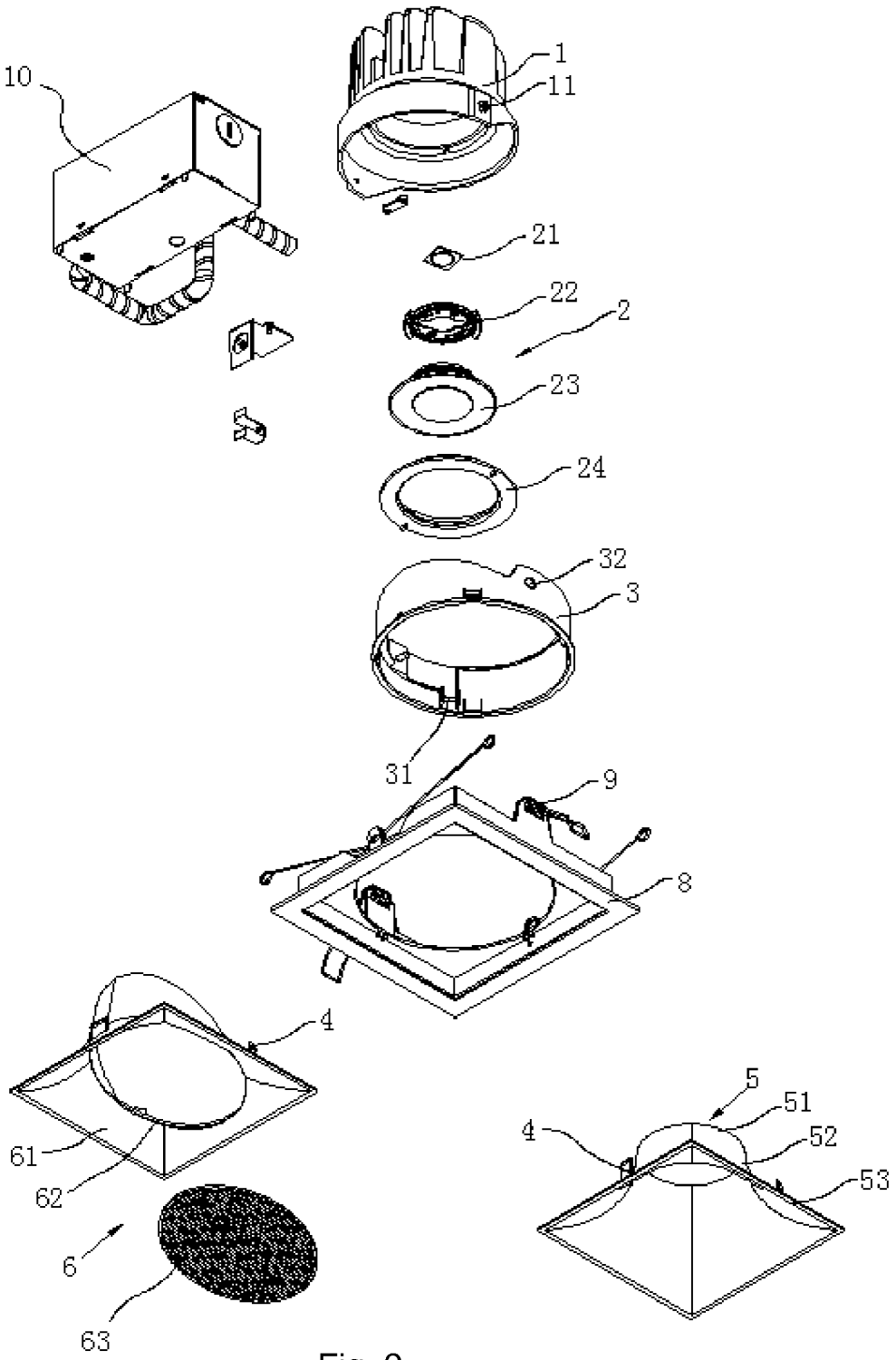
FIG. 2 illustrates an exploded diagram of the embodiment of FIG. 1.
Figure 5:
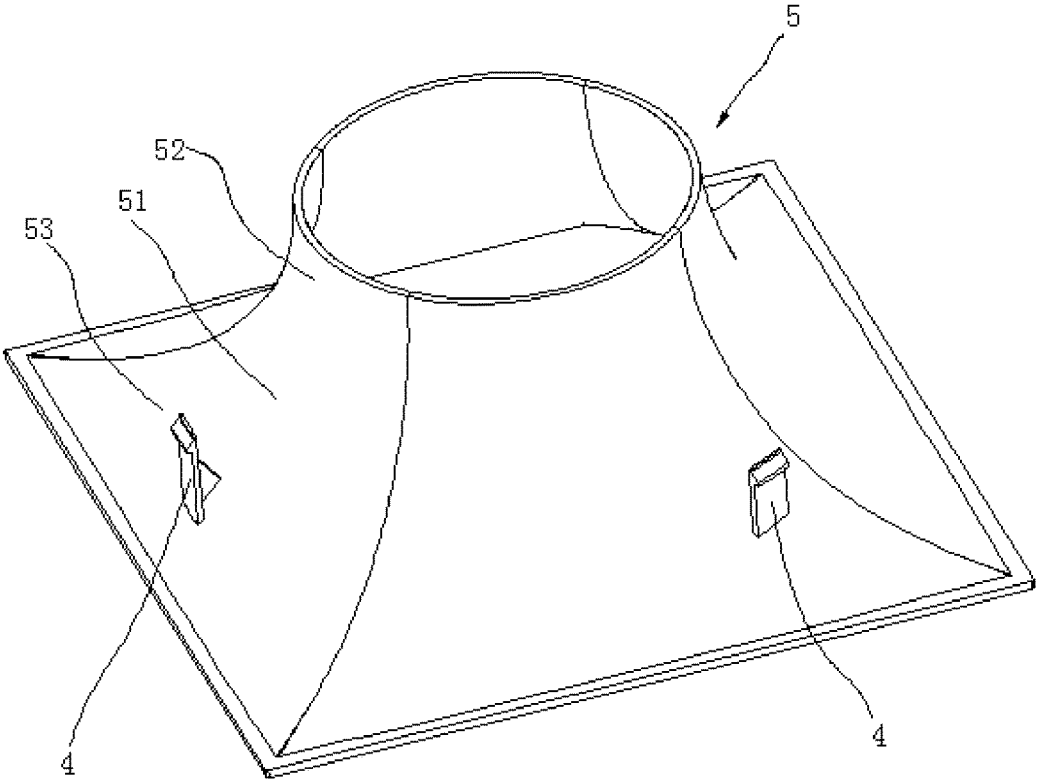
FIG. 5 shows an example of a downlight reflector.

Furthermore, please refer to FIG. 2 and FIG. 5 for the following detail implementation description of the new multifunction lighting apparatus embodiment. The downlight reflective optic 5 includes middle expansion section 51, the cylinder light condensing section 52 that is disposed at the upper end of the middle expansion section 51, and installation section 53 that is disposed at the bottom end of the middle expansion section 51. Each of the clip unit 4 is disposed on the installation section 53.

In an embodiment, the downlight reflective optic 5 is disposed at the middle expansion section 51. The cylinder light condensing section 52 is disposed at the upper end of the middle expansion section 51. Place the cylinder light condensing section 52 within the opening of the downlight 1 to enhance a spotlight effect of the downlight reflective optic 5 and improve the illumination effect of the multifunction lighting apparatus when used as downlight. Simultaneously, the installation section 53 is disposed at the bottom end of the middle expansion section 51 and each of the clip unit 4 is disposed on installation section 53. Through the correspondence of a clip unit 4 of the installation section 53 and the connection groove 31 of the adjustment bracket 3. This simplifies the detachment of downlight reflective optic 5 and enhances the efficiency for multifunction light apparatus assemblies.

Figure 6:
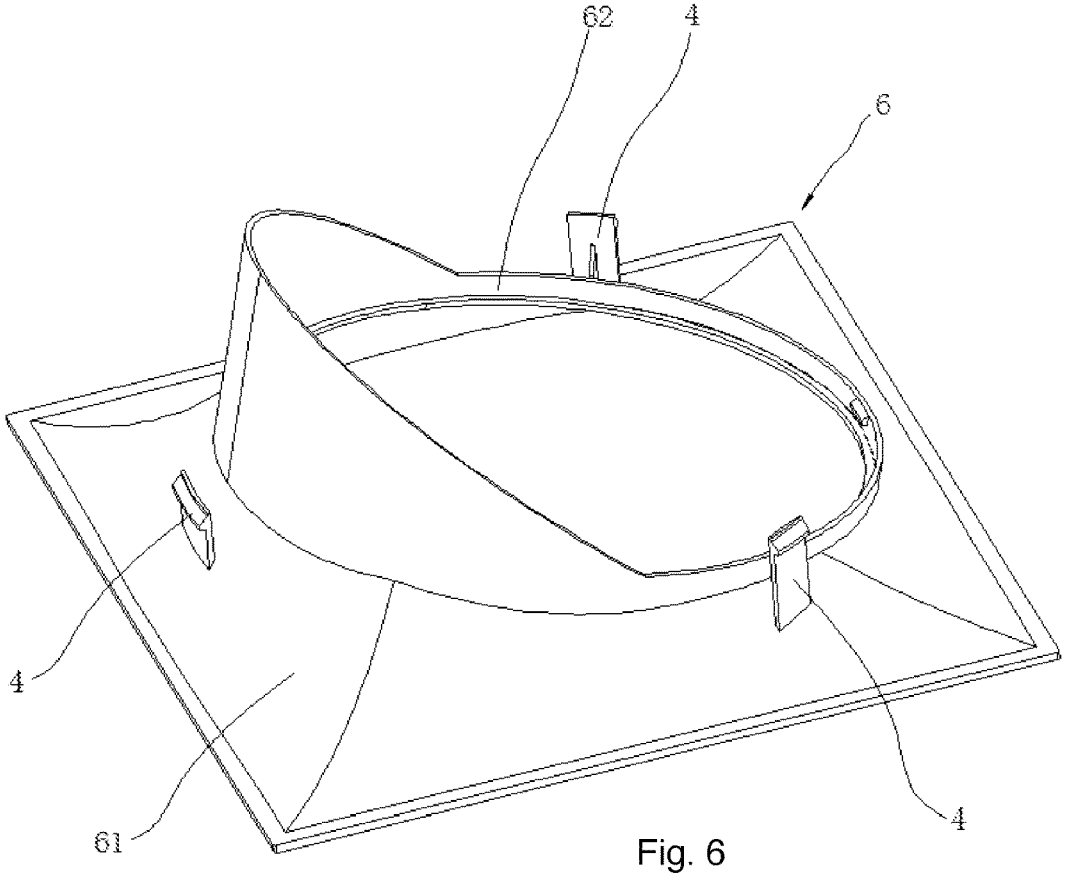
FIG. 6 shows an example of a wall grazer reflector.

Furthermore, please refer to FIG. 2 and FIG. 6 for the following detail implementation description of the new multifunction lighting apparatus embodiment. The wall grazer light reflective optic 6 includes downlight 1's gradually expanding the reflector 61 and the polarizer 63 that is disposed within reflector 61. Each of the clip unit 4 is disposed at the bottom end of the reflector 61.

In an embodiment, the wall grazer light reflective optic 61 is replaced with a gradually expanding reflector 61 that is disposed near one end of the downlight 1 to the other end. The Polarizer 63 is disposed within reflector 61 for polarized lighting to enhance bloom lighting when the multifunction lighting apparatus is used as wall grazer light. Decorative illumination will also be enhanced. Simultaneously, the reflector 61 is disposed with multiple clip unit 4. The clip unit 4 of the reflector 61 corresponds with the connecting groove 31 of the adjustment bracket 3. This makes it easier for the wall grazer light reflective optic 6 to detach and enhances the efficiency for the assembly of the multifunction lighting apparatus.

Furthermore, please refer to FIG. 2 and FIG. 6 for the following detail implementation description of the new multifunction lighting apparatus embodiment. The ring groove 62 of the reflector 61 is equipped with positioning the polarizer 63, making it easier for the polarizer 63 to be installed within the reflector 61. This enhances efficiency when assembling and its user friendliness. Simultaneously, when positioning installation polarizer 63 through the ring groove 62, the polarizer 63 may be securely installed within reflector 61 to achieve better bloom lighting effect. Decorative illumination effect is also enhanced when multifunction lighting apparatus switches to wall grazer light mode.

Preferably, the ring groove 62 is disposed near the upper end of the reflector 61 that is closer to downlight 1. The ring groove 62 is equipped with polarized prism plate. This enhances the polarized angle of light of the light source module 2 when the multifunction lighting apparatus is used as the wall grazer light. Shadowy part of the upper wall will lose its effect on wall grazer lights' decorating illumination effect. Users have more positive wall grazer light feedback.

Figure 4:
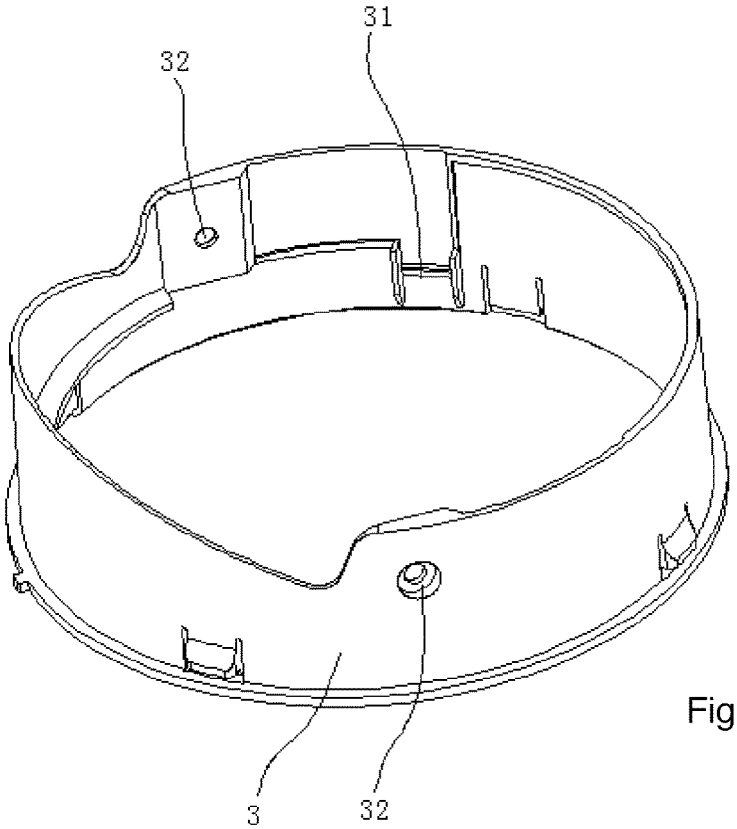
FIG. 4 shows an adjustment bracket example.

Furthermore, please refer to FIG. 2 and FIG. 4 for the following detail implementation description of the new multifunction lighting apparatus embodiment. A lock bolt 11 is installed on both sides of downlight 1. The adjustment bracket 3 is disposed with the holes 32 for the lock bolt 11 to go through. When in use, adjusting the lock bolt 11 of the downlight 1 may position the rotation of the adjustment bracket 3 on the outer side of the downlight 1. Thus, the rotation angle of adjustment bracket 3 and downlight 1's equivalent position may be adjusted.

In an embodiment, rotating positioning adjustment bracket 3 is disposed on downlight 1. Adjustment bracket 3 may then rotate in correspondence with the rotating angle of the downlight 1. The light source module 2 of the illuminating light body may then rotate in correspondence with the reflection cup. The light energy utilization enhanced, providing better illumination effect. Especially when using multifunction lighting apparatus as wall grazer light mode, the rotating adjustment of the light when emitted from light source module 2 and into polarizer 63 keeps the light emitting surface of the light body aligned with polarizer 63, making the most of the light energy. This creates better bloom lighting effect and enhances decorative illumination when multifunction lighting apparatus is used as the wall grazer light mode. In addition, the corresponding the light body rotation of the wall grazer light reflective optic 6's polarizer forms a fixed angle between the light emitting surface of the light body and the polarizer 63. The polarized lighting is thus created.

Figure 1:
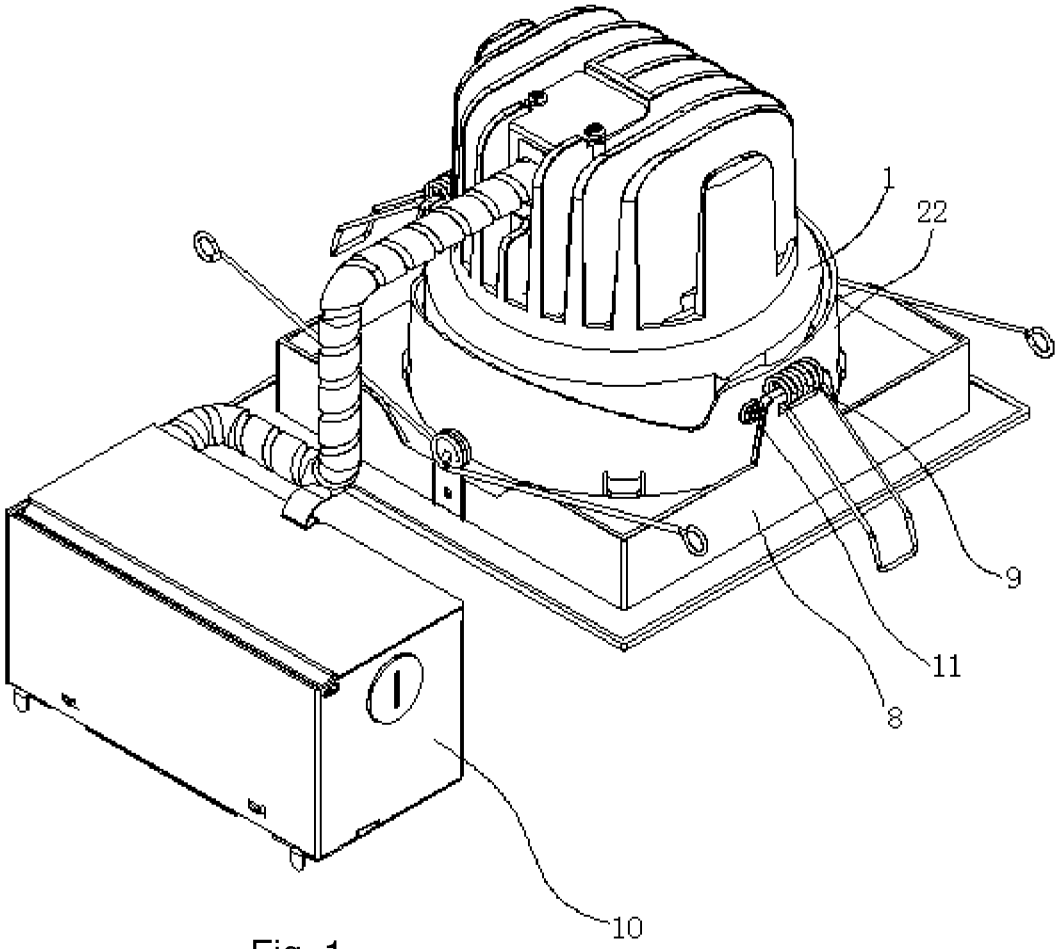
FIG. 1 illustrates a multifunction lighting apparatus embodiment.
Figure 3:
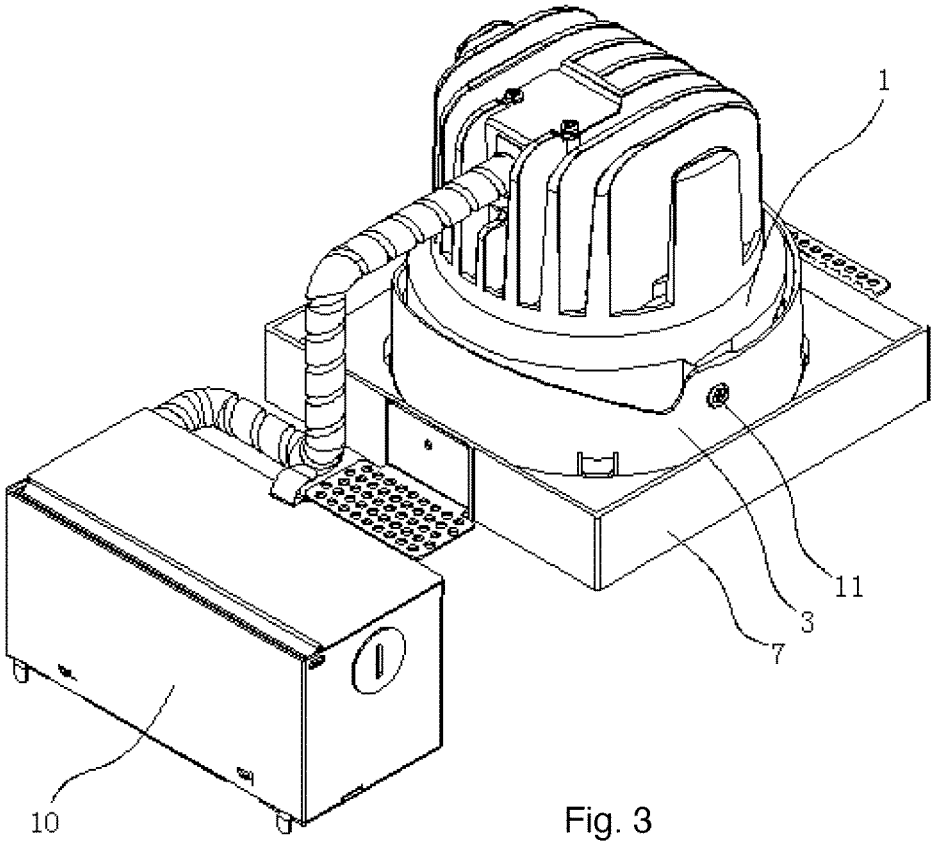
FIG. 3 shows another view of the embodiment of FIG. 1

Furthermore, please refer to FIG. 1 to FIG. 3 for the following detail implementation description of the new multifunction lighting apparatus embodiment. Multifunction lighting apparatus includes a ring surface that is disposed at the outer surface of the reflection cup body. The ring surface is connected to the adjustment bracket 3.

In an embodiment, ring surface is disposed at the outer surface of the reflection cup body. This maintains the beauty and the reflection cup body of the light body may also be securely protected. The multifunction lighting apparatus may therefore be installed on the wall or ceiling.

Figure 7:
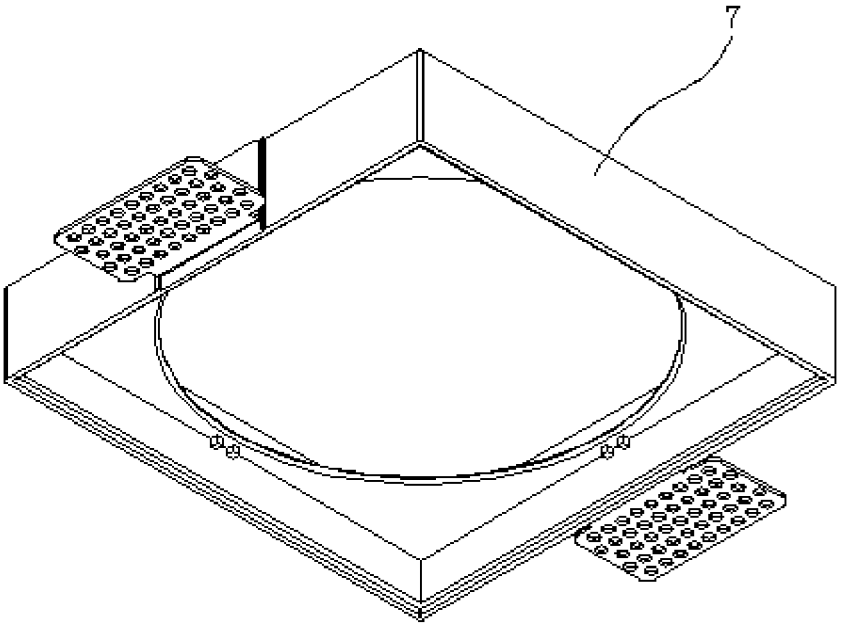
FIG. 7 shows a frameless base arrangement of a frame component.
Figure 8:
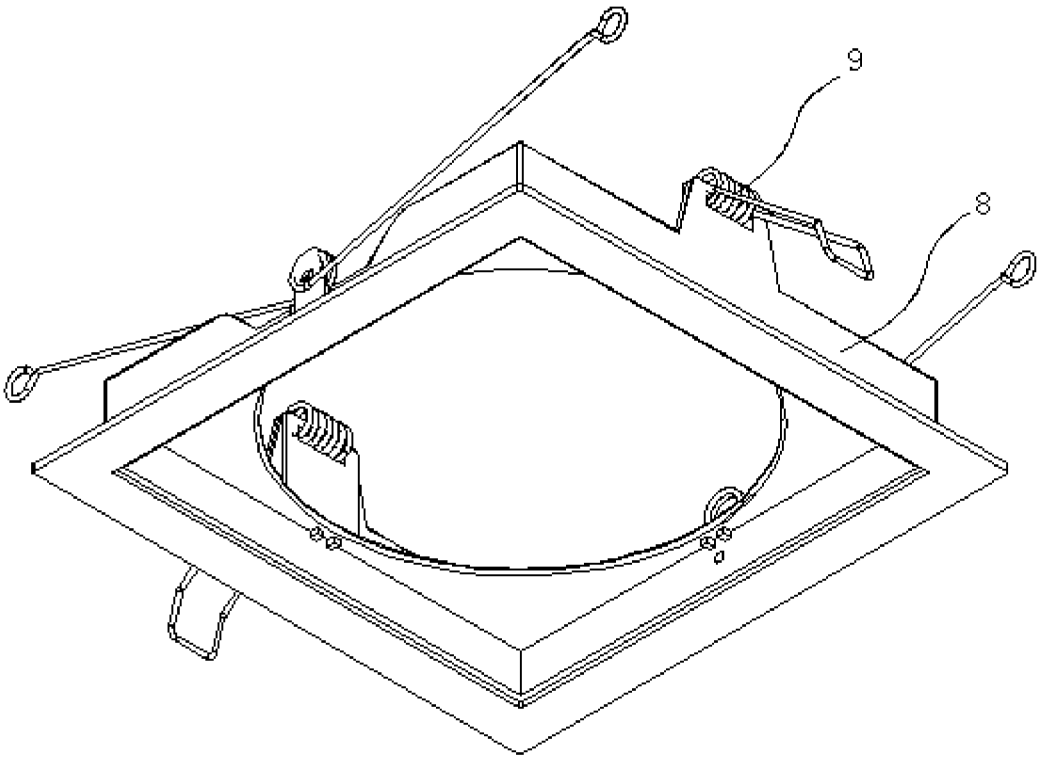
FIG. 8 shows a frame base arrangement of a frame component.

Furthermore, please refer to FIG. 7 and FIG. 8 for the following detail implementation description of the new multifunction lighting apparatus embodiment. The ring surface may be a frameless ring surface 7 or a frame ring surface 8. The ring surface and the adjustment bracket 3 may be detached and connected.

In an embodiment, the frameless ring surface 7 or the frame ring surface 8 may be detached and connected to adjustment bracket 3. This makes it easier to switch between the frameless ring surface 7 and the frame ring surface 8 of the light body. The users may conveniently switch between the frameless ring surface 7 or the frame ring surface 8. Utilization cost is reduced.

Furthermore, please refer to FIG. 8 for the following detail implementation description of an embodiment of the new multifunction lighting apparatus. The ring surface includes installation units that is disposed on the frameless ring surface 7 and/or the frame ring surface 8. The installation unit is installation plate and/or the installation spring 9. This makes it much easier for users to install, enhances the assembly efficiency of the ring surface, and secure the installation of the ring surfaces.

Preferably, the installation spring 9 includes the North American installation spring. This is to match American standards for installing within downlight. Not only the multifunction lighting apparatus suits the European ceilings, it also suits North American new building structures.

Furthermore, please refer to FIG. 1 to FIG. 3 for the following detail implementation description of an embodiment of the new multifunction lighting apparatus. The multifunction lighting apparatus includes the light source driver 10 which drives the light source module 2 to illuminate. Light source driver 10 and an electricity property of the light source module 2 connects to each other. Among them, the light source driver 10 includes an intelligent Al card, a remote control panel, and/or a mobile device that may be controlled through APP. The light source driver 10 uses the intelligence control to control the color temperature of the multifunction lighting apparatus light source 21. This may achieve the light source 21 color temperature switches and adjust output power.

Furthermore, for the following detail implementation description of the new multifunction lighting apparatus embodiment, the light body includes a heat sink that is disposed on downlight 1. This is to immediately cool down a work heat of the light source module 2 for light body to function properly within different illumination flux ranging from 500 LM-4000 LM. Preferably, an aluminum casting heat sink, so the heat produced by light source 21 may be quickly cooled down to reach warranty's fifty-thousand-hour life span command.

The above description is only the better embodiments. This does not limit the new model. For all amendments, replacements, and rebuild within the new spirit and principle, should all be protected within the new model. In addition to the above-described embodiments, various modifications may be made, and as long as it is within the spirit of the same invention, the various modifications may be made by those skilled in the art are belong o the scope of the present invention.

The invention claimed is:

1. A multifunction lighting apparatus, comprising:

a light body for emitting a light;

an adjustment bracket, the light body being fixed to the adjustment bracket and being movable with respect to the adjustment bracket;

a frame for supporting and fixing the adjustment bracket;

a first optical unit being detachable from the light body to be replaced with a second optical unit; and a driver box containing a driver for converting an indoor power to a driving current to the light source, wherein the driver box is made of metal material, wherein there is a rotation structure for connecting the adjustment bracket and the light body so that the light body is rotatable with respect to the adjustment bracket for changing an output direction of the light, wherein the first optical unit comprises a downlight reflector, and the second optical unit comprises a wall grazer reflector, wherein the output light direction of the light is adjusted with different tilt angles between using the downlight reflector and the wall grazer reflector.

2. The multifunction lighting apparatus of claim 1, wherein when the light body is shifted with respect to the adjustment bracket, a beam angle of an output light is changed accordingly.

3. The multifunction lighting apparatus of claim 1, wherein the second optical unit further comprises a polarizing lens.

4. The multifunction lighting apparatus of claim 1, wherein the light body has a metal housing, a light source and a light body lens.

5. The multifunction lighting apparatus of claim 4, wherein the metal housing carries heat of the light source away from the light source.

6. The multifunction lighting apparatus of claim 4, wherein the light body comprises a first body and a second part, a relative distance between the first body and the second part is adjustable for changing a relative position of the light source to the light body lens for outputting different light patterns.

7. The multifunction lighting apparatus of claim 1, wherein the driver box is kept with no direct contact with a metal housing of the light body.

8. The multifunction lighting apparatus of claim 1, wherein the driver box contacts a metal housing of the light body for helping heat dissipation of the light source.

* * * * *